US010054385B1

(12) United States Patent
Dvorak

(10) Patent No.: US 10,054,385 B1
(45) Date of Patent: Aug. 21, 2018

(54) LASER ATTACHMENT FOR FIREARMS AND FIREARM SIMULATORS

(71) Applicant: Vojtech Dvorak, Tulsa, OK (US)

(72) Inventor: Vojtech Dvorak, Tulsa, OK (US)

( * ) Notice: Subject to any disclaimer, the term of this patent is extended or adjusted under 35 U.S.C. 154(b) by 0 days.

(21) Appl. No.: 15/607,672

(22) Filed: May 29, 2017

Related U.S. Application Data

(63) Continuation-in-part of application No. 14/997,507, filed on Jan. 16, 2016, now abandoned, which is a continuation-in-part of application No. 14/480,635, filed on Sep. 9, 2014, now Pat. No. 9,297,607.

(60) Provisional application No. 61/939,273, filed on Feb. 13, 2014.

(51) Int. Cl.
*F41A 33/06* (2006.01)
*F41A 33/02* (2006.01)

(52) U.S. Cl.
CPC ..... *F41A 33/06* (2013.01); *F41A 33/02* (2013.01)

(58) Field of Classification Search
CPC ..... F41B 11/50; F41B 11/62; F41B 11/723; F41A 33/02; F41A 33/06
USPC ..... 124/70, 71, 73, 75–77
See application file for complete search history.

(56) References Cited

U.S. PATENT DOCUMENTS

| | | | | |
|---|---|---|---|---|
| 2,110,509 A | | 3/1938 | Von Latscher | |
| 2,605,756 A | | 8/1952 | Bertschinger | |
| 3,938,262 A | | 2/1976 | Dye | |
| 3,951,038 A | | 4/1976 | Van Langenhoven | |
| 4,195,422 A | | 4/1980 | Budmiger | |
| 4,352,665 A | | 10/1982 | Kimble | |
| 4,370,822 A | | 2/1983 | Rabino | |
| 4,380,437 A | | 4/1983 | Yarborough | |
| 4,480,999 A | | 11/1984 | Witherell | |
| 4,761,907 A | | 8/1988 | DeBernardini | |
| 4,830,617 A | * | 5/1989 | Hancox | F41A 33/02 362/111 |
| 4,983,123 A | * | 1/1991 | Scott | F41A 33/02 362/111 |
| 5,488,795 A | * | 2/1996 | Sweat | F41A 33/02 362/112 |
| 5,716,216 A | | 2/1998 | O'Loughlin | |
| 5,947,738 A | | 9/1999 | Muehle | |
| 6,146,141 A | | 11/2000 | Schumann | |
| 6,572,375 B2 | | 6/2003 | Shechter | |
| 6,682,350 B2 | | 1/2004 | Kehl | |
| 6,869,285 B1 | | 3/2005 | Jones, II | |
| 7,621,747 B1 | | 11/2009 | Burrow | |
| 8,602,784 B2 | | 12/2013 | Dvorak | |
| 9,146,069 B2 | | 9/2015 | Monti | |
| 9,297,607 B2 | * | 3/2016 | Dvorak | F41B 11/62 |
| 2002/0116855 A1 | | 8/2002 | Iten | |
| 2002/0134000 A1 | | 9/2002 | Varshneya | |

(Continued)

FOREIGN PATENT DOCUMENTS

DE 103 49 194 A1 4/2005

*Primary Examiner* — Bret Hayes
(74) *Attorney, Agent, or Firm* — James R Bell

(57) ABSTRACT

A shock activated laser module for simulated shooting transmits a brief laser beam to mark a point of impact. The module includes a housing, an electro-optical member, a stored energy member and a retaining cap securing the electro-optical member and stored energy member in the housing. The laser module housing is selectively attached in combination to any one of a simulated firearm barrel, a simulated firearm gas reservoir, or to an actual firearm for dry-firing practice.

9 Claims, 10 Drawing Sheets

(56) References Cited

U.S. PATENT DOCUMENTS

| | | | | |
|---|---|---|---|---|
| 2005/0074726 | A1 | 4/2005 | Metcalfe | |
| 2005/0191601 | A1 | 9/2005 | Dvorak | |
| 2005/0260545 | A1 | 11/2005 | Schavone | |
| 2006/0027225 | A1 | 2/2006 | Homsky | |
| 2006/0265929 | A1 | 11/2006 | Haney | |
| 2011/0281243 | A1 | 11/2011 | Uhr | |
| 2011/0287389 | A1* | 11/2011 | Uhr | F41G 3/2655 434/21 |
| 2013/0008421 | A1 | 1/2013 | Lee | |
| 2014/0026878 | A1 | 1/2014 | Jones | |
| 2015/0362276 | A1 | 12/2015 | Fischer | |

* cited by examiner

LASER ATTACHMENT FOR FIREARMS AND FIREARM SIMULATORS

CROSS-REFERENCE TO RELATED APPLICATIONS

This application is a continuation-in-part of U.S. Non-Provisional application Ser. No. 14/997,507 filed Jan. 16, 2016, which is a continuation-in-part of U.S. Non-Provisional application Ser. No. 14/480,635 filed Sep. 9, 2014 and is related to and claims priority to U.S. Provisional Application No. 61/939,273 filed Feb. 13, 2014, which is incorporated herein by reference in its entirety.

BACKGROUND

This disclosure relates generally to converting an actual firearm to a firearm simulator and more particularly to either a long gun or a handgun weapon simulator.

Firearms have been converted into firearm simulators by replacement of parts of the firearm with simulator parts for simulated shooting such that the resultant firearm comprises a combination of actual firearm components and simulated firearm components. The simulated firearm components have included a simulated barrel unit and a simulated magazine unit. The prior simulated magazine units have included a compressed gas container or a connection to an external compressed gas source. The compressed gas is used to provide energy to operate the weapon simulator by actuating valve means in the simulated barrel unit. The compressed gas is conducted from the compressed gas container, or the external compressed gas source to the simulated barrel unit.

When actuated, the valve means forces movement of a slide and compression of a recoil spring and subsequent venting. The resulting recoil simulates the feel of actual weapon firing. A laser beam pulse means is responsive to the simulated weapon firing whereby the laser beam pulse means emits a laser beam onto a target. It would be advantageous to improve simulated weapon firing by reducing the number of parts resulting in a reduction of cost, and also a less complex weapon simulator.

SUMMARY

A shock activated laser module for simulated shooting transmits a brief laser beam to mark a point of impact. The module includes a housing, an electro-optical member, a stored energy member and a retaining cap securing the electro-optical member and stored energy member in the housing. The laser module housing is selectively attached in combination to any one of a simulated firearm barrel, a simulated firearm gas reservoir, or to an actual firearm for dry-firing practice.

DETAILED DESCRIPTION

Figure 1:
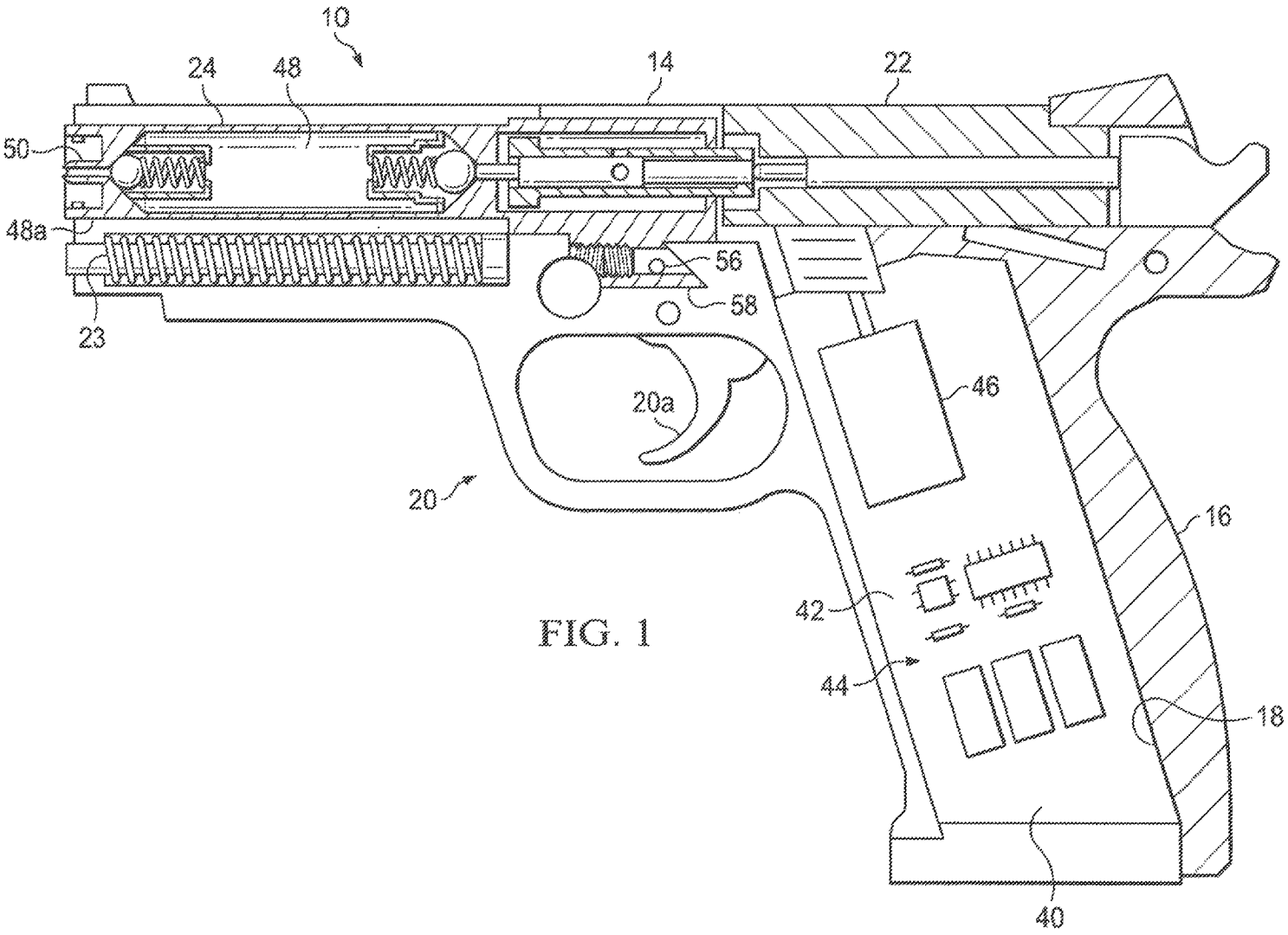
FIG. 1 is a cut-away side view illustrating an embodiment of a handgun configured for simulated firing.

Apparatus is provided for non-permanent conversion of a firearm into a compressed gas powered firearm simulator for simulated shooting. The firearm includes a combination of actual firearm components and simulated firearm components. The firearm may be a handgun 10, FIG. 1 or may be a long gun 12, FIG. 2. The handgun 10, includes a frame 14 having a grip portion 16, a magazine portion 18, a trigger portion 20, a slide portion 22 and a recoil spring 23. A firearm barrel portion (not shown) is replaced by a simulated barrel unit 24. The long gun 12, FIG. 2, includes a frame 26 having a stock portion 28, a magazine portion 30 and a trigger portion 32. A firearm barrel portion (not shown) is replaced by a simulated barrel unit 34, a simulated bolt 36 and recoil spring 38. As used herein, the term long gun may include a rifle or shotgun of the repeating, single shot, semiautomatic or automatic type.

Figure 2:
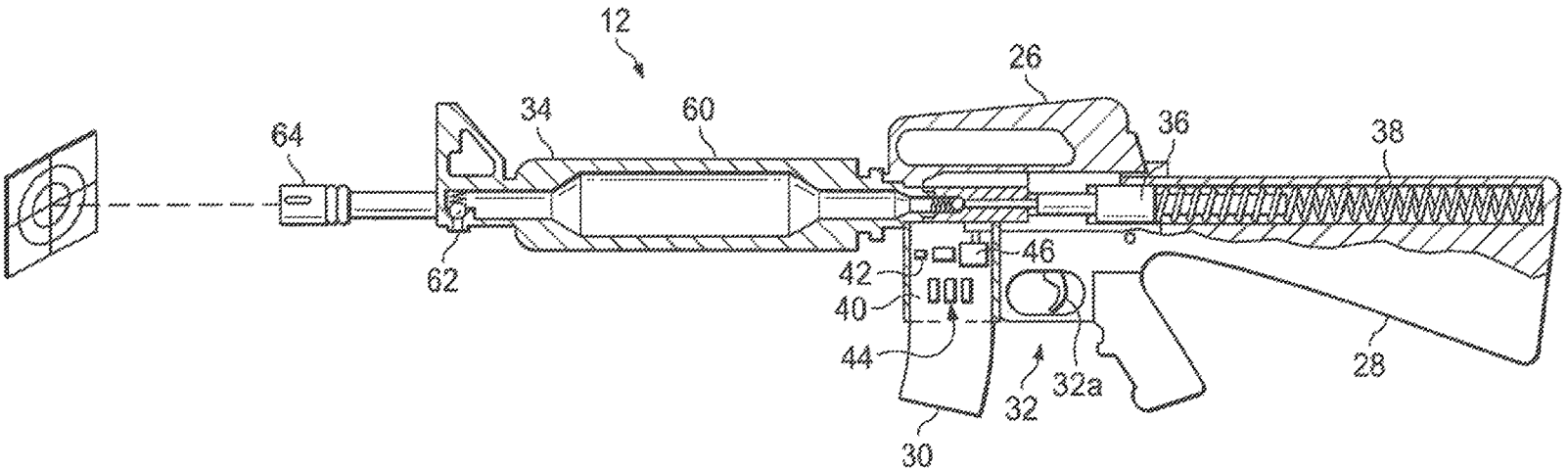
FIG. 2 is a cut-away side view illustrating an embodiment of a long gun configured for simulated firing.

Additional features of the pistol 10, FIG. 1, and rifle 12, FIG. 2 include a simulated magazine unit 40 which may include a shot counter 42, a receiver 44 for receiving a remote signal to simulate a jam in the firearm, and an actuator 46 to interrupt simulated firing in response to a predetermined number of simulated shots being fired.

Figure 3:
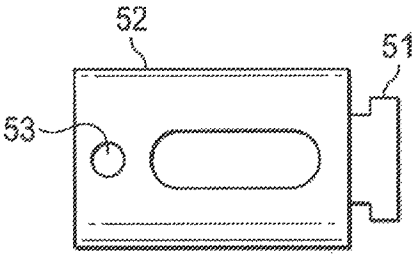
FIG. 3 is a side view illustrating an embodiment of a laser unit used with a simulated firearm.

The simulated barrel unit 24, FIG. 1, includes a reservoir or chamber 48 for sealingly storing a compressed gas such as $CO_2$. One end 48*a* of cylinder 48 is threaded and includes a fill port 50 which may be of the male or female type and a check valve. Also, the end 48*a* may be a twist-lock, a quick-lock or a bayonet type of latching mechanism as an alternative to being threaded. The threaded end 48*a* can threadably receive a laser unit 52, FIG. 3. The laser unit 52 is sight adjustable via an adjustment screw 53, and is threadably removable 51 from end 48*a* to provide access to fill port 50. In addition, reservoir 48 may be attached to a larger capacity auxiliary reservoir 54, FIG. 4, to increase the available number of simulated shots. Referring again to FIG. 1, an adjustment screw 56 and pin 58 arrangement is provided adjacent the trigger portion 20 to take up play due to production tolerances in various handgun makes and models when simulated barrel unit 24 is installed in frame 14. It is shown herein that the term fill port can be located in line with a barrel end or may be a side fill port on the side of a barrel.

Figure 4:
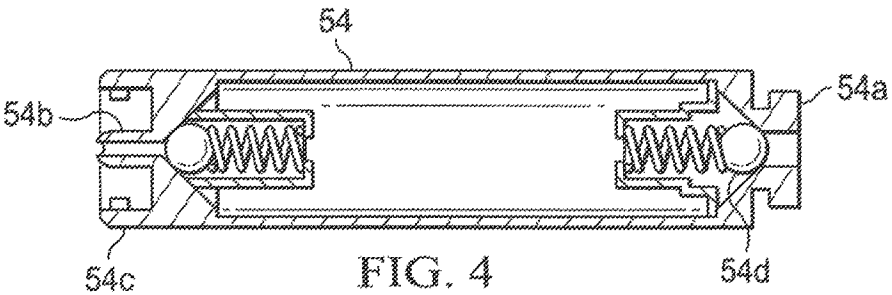
FIGS. 4 and 6*a* are cut-away side views illustrating an embodiment of an external compressed gas reservoir attached to a barrel unit of a simulated firearm.

The reservoir 48, FIG. 1, is size enhanced by attachment of the supplemental, and larger capacity, auxiliary reservoir 54, FIG. 4, to increase the available number of simulated shots. The auxiliary reservoir 54 includes a threaded first end 54*a* and a fill port 54*b* at a threaded second end 54*c*. Thus, removal of laser unit 52 from end 48*a* of reservoir 48 permits the auxiliary reservoir first end 54*a* to be threaded onto the threaded end 48*a* of reservoir 48 such that the fill port 50 engages and unseats a ball 54*d* resiliently seated at the first end 54*a* of reservoir 54. This provides open fluid communication between the reservoirs 48 and 54. Laser unit 52 is then threaded into the second end 54*c*. In this manner, the auxiliary reservoir 54 is added to enhance the simulated firing capacity of handgun 10.

Figure 6:
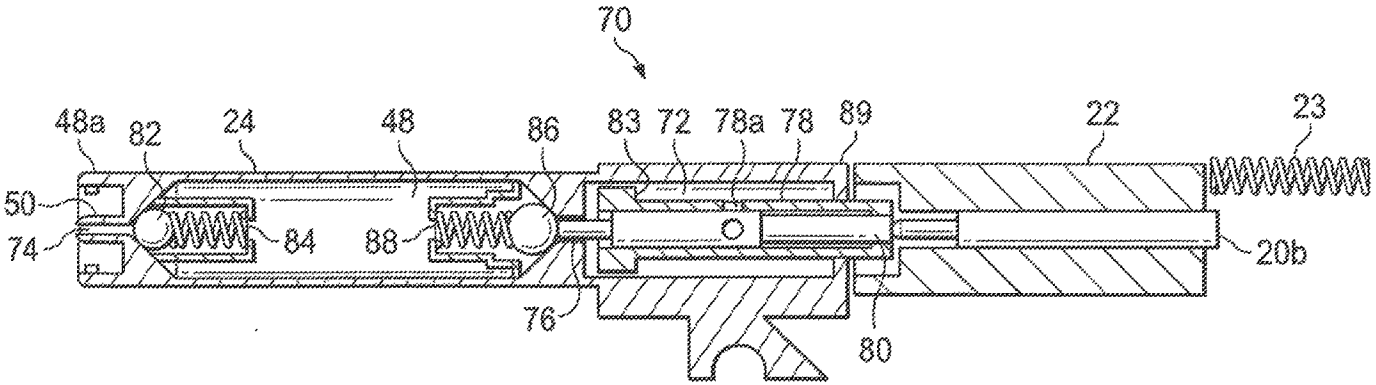
FIGS. 6-6*f* and 7 are cut-away side views illustrating embodiments of simulated barrel units for use in converting actual firearms into simulated handguns and long guns, respectively.

Referring to FIGS. 1 and 6, the simulated firing of handgun 10 is further discussed below. The simulated barrel unit 24 includes a housing 70 which contains a chamber 72 and the reservoir 48. Fill port 50 is positioned at threaded end 48*a* of housing 70 and the chamber 72 is at an opposite end of housing 70. Reservoir 48 includes an inlet 74 in fill port 50 at end 48*a* and an outlet 76 fluidly connecting reservoir 48 with chamber 72. A piston 78 includes a striker 80 movably retained in the piston 78. A fill port 50 is provided with a one-way check valve, which may be a ball valve 82, or other shaped valve member, which is resiliently urged by optional spring 84 to seat and seal inlet 74, and a second or metering valve 86 is provided which may also be a ball or other suitable shape, which is resiliently urged by spring 88 to seat and seal outlet 76. Actuation of a trigger 20*a* in trigger portion 20 urges a firing pin 20*b* into engagement with striker 80, which is moved sufficiently to unseat valve 86 and admit the compressed gas from reservoir 48 into chamber 72. As a result, slide portion 22 and piston 78 are urged rearwardly along with striker 80. Shoulder 83 of piston 78 stops further rearward movement of piston 78 due to engagement with a shoulder 89 of chamber 72. The slide 22 continues in further rearward motion until venting occurs followed by forward motion of the slide 22 due to a recoil spring 23. During the recoil cycle, FIG. 6*a* when piston 78 stops moving aft, striker 80 telescopes out of the piston 78 and moves the slide 22 rearward, thus harnessing energy of the compressed gas to do useful work. When striker 80 passes across exhaust vent 78*a*, pressure escapes with an audible puff. In several applications shown herein, metering is achieved by predetermined stiffness of a spring (or other resilient member) and predetermined movement of the valve tappet (ball or other shape). A valve housing sets compression of the valve spring and limits movement of the valve tappet. This determines the time duration of the valve to stay open, which meters the amount of gas injected into an associated recoil chamber, e.g. 72, 90, 122, see FIGS. 6, 7 and 8, which produces the desired amount of recoil.

Figure 6A:
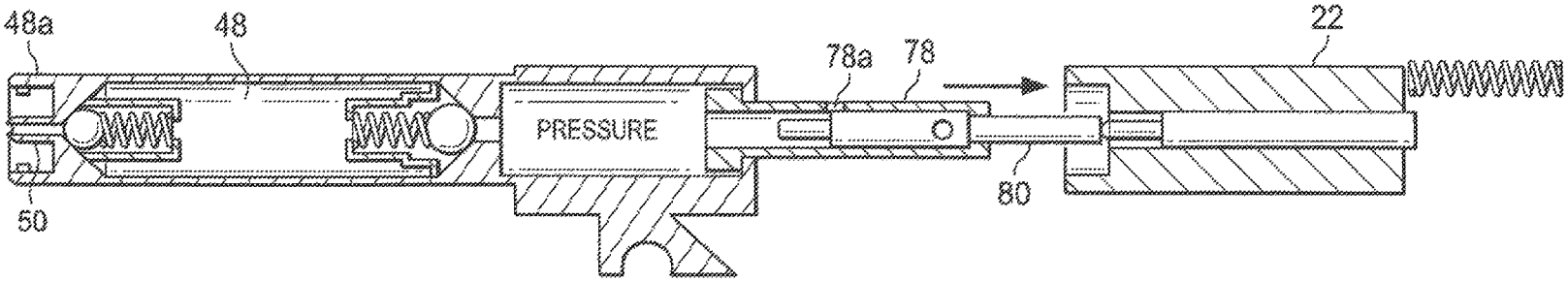
Figure 6B:
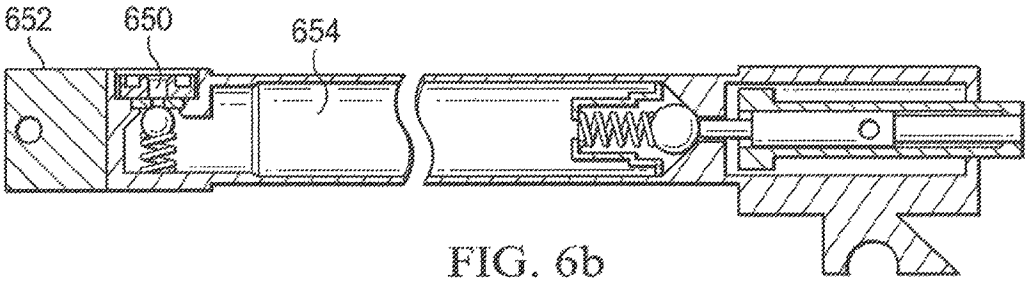

As an alternative, an auxiliary reservoir 654, FIG. 6*b* may include a side fill port 650 instead of fill port 50 as illustrated in FIGS. 1 and 6*a*. Thus, a laser unit 652, FIG. 6*b*, may be suitably connected to an end of reservoir 654 adjacent the side fill port 650.

Figure 6C:
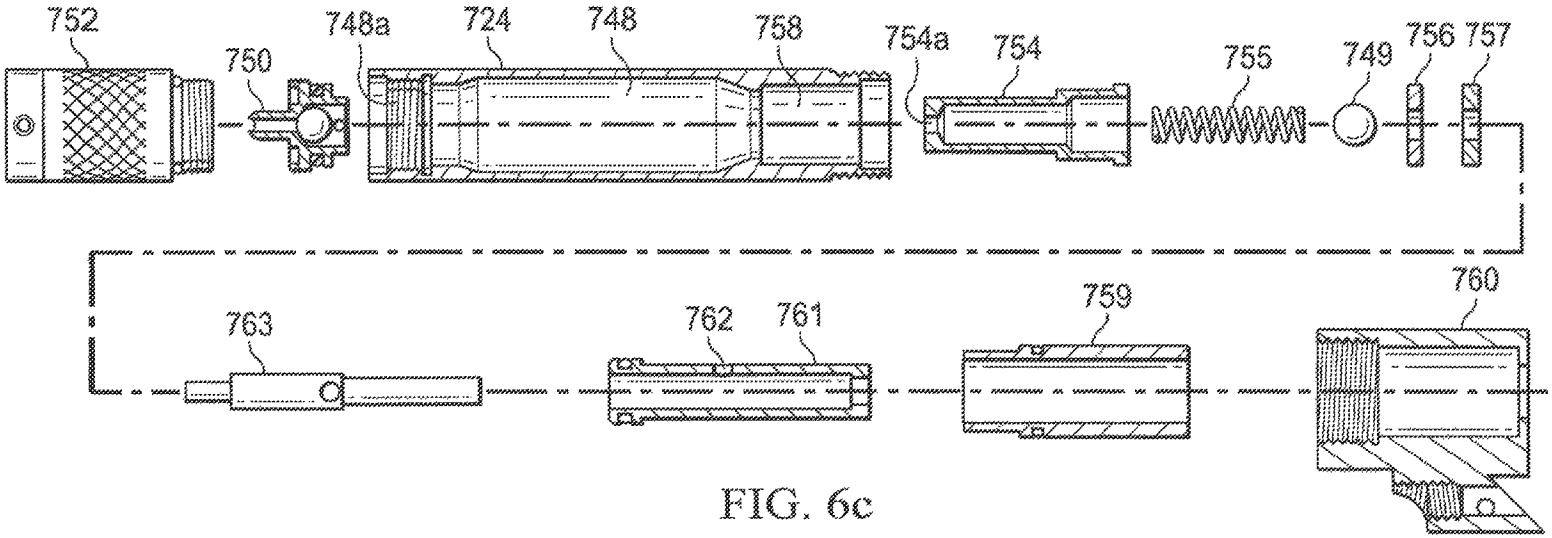
Figure 6D:
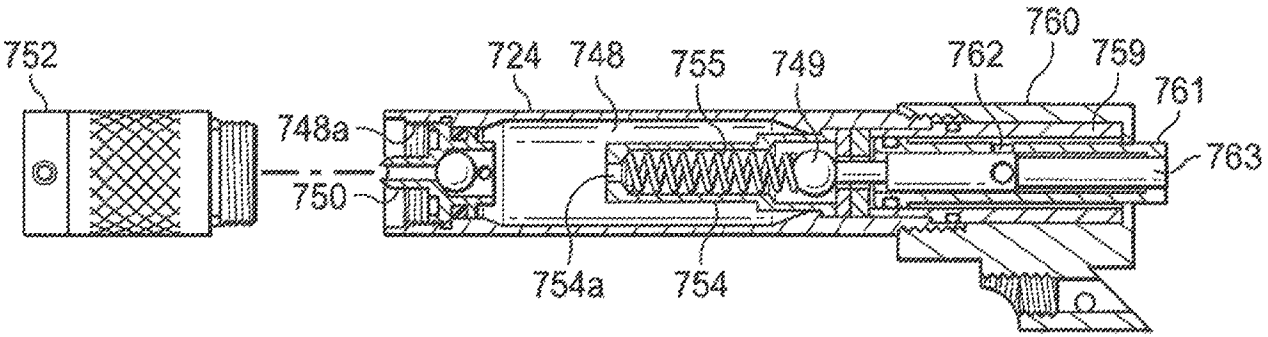

Another barrel unit 724 FIGS. 6*c* and 6*d*, may include a reservoir 748. One end 748*a* of reservoir 748 is threaded and includes a fill port 750. The threaded end 748 can receive a laser unit 752, similar to the laser units described above. A valve housing 754 may be inserted into reservoir 748 for receiving a valve member 749 resiliently urged by a spring member 755. A flexible seal 756 and a rigid washer 757 seat in a chamber 758. A sleeve insert 759 is sealingly seated in a barrel block 760 and a piston 761 seated in insert 759 receives a striker 763. An exhaust port 762 is provided in piston 761. When actuated by a trigger, as described above, striker 763 displaces valve member 749 sufficiently to permit compressed gas from reservoir 748 to pass through a port 754*a* in housing 754 and bypass seal 756 and washer 757 and urge piston 761 and striker 763 aft of sleeve insert 759 until venting occurs from exhaust port 762 in piston 761 thus providing the recoil and audible puff sensations as described above, see also FIG. 6*f*.

Figure 6E:
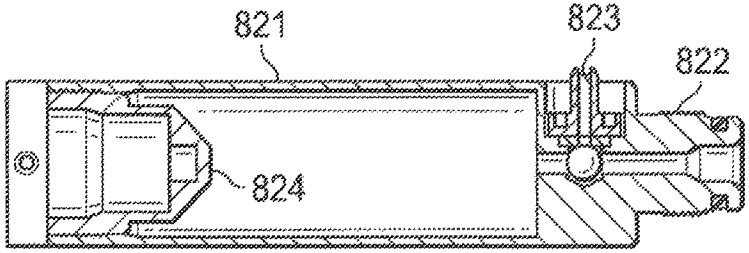
Figure 6F:
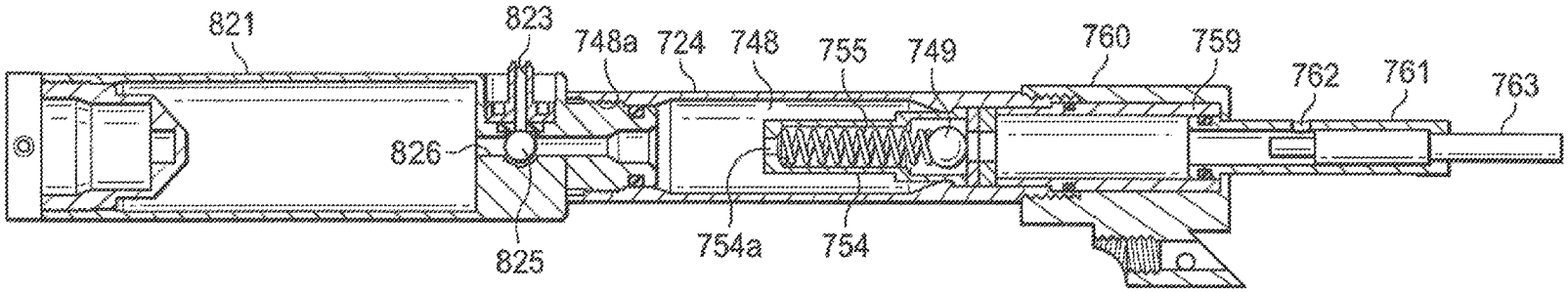

In FIGS. 6*e* and 6*f*, the reservoir 748 is size enhanced by attachment of a supplemental, and larger capacity, auxiliary reservoir 821 including a sealed insert 822 and a side fill port 823 adjacent sealed insert 822. An opposite end of reservoir 821 includes a laser unit 824. Removal of fill port 750 from barrel unit 724, FIG. 6*d*, permits attachment of sealed insert 822 to the end 748*a* of barrel unit 724. Side fill port 823, FIGS. 6*e* and 6*f*, is sealed by a valve 825 when cylinders 821 and 748 are pressurized. A passage 826 interconnects reservoirs 821 and 748 so that pressurized gas in reservoirs 821 and 748 is available for simulated firing. Housing 754 also maintains valve member 749 and spring 755 in a desired position for effective operation.

Figure 5:
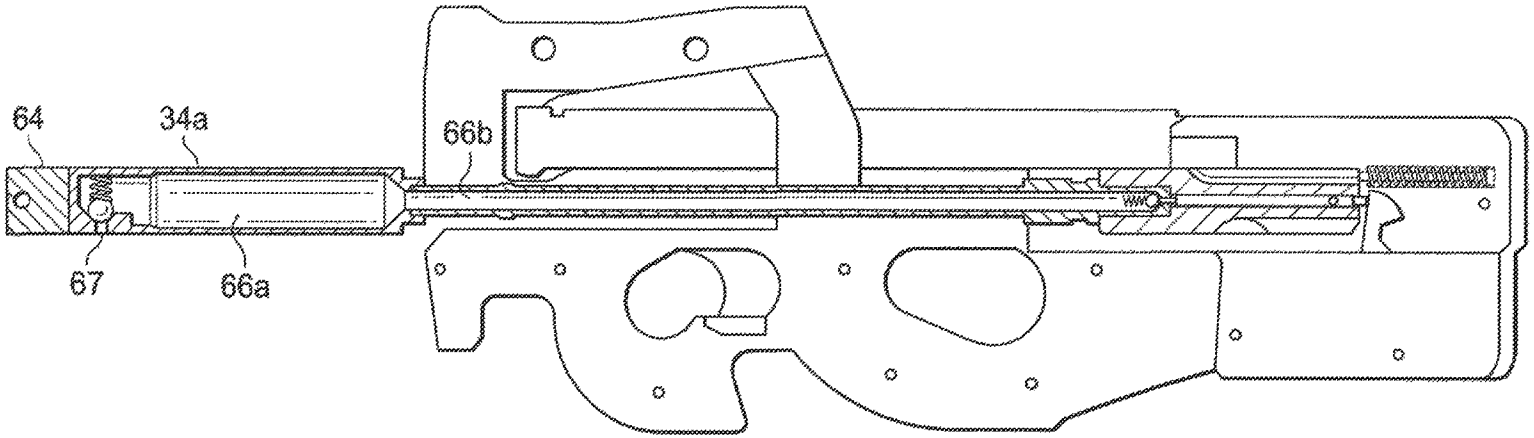
FIG. 5 is a cut-away side view illustrating another embodiment of a long gun configured for simulated firing.

Referring to the long gun 12, FIG. 2, the simulated barrel unit 34 includes a reservoir 60 for sealingly storing the compressed $CO_2$ gas. One end of the reservoir 60 may include a fill port as discussed above, but is illustrated to include an alternative side fill port 62, to be discussed further below. Also, a laser unit 64 is attached to barrel unit 34 adjacent to the side fill port 62. Due to the alternative side fill port 62, the laser unit 64 may be removably attached via a threaded connection as discussed above, or may be optionally fixedly attached to the simulated barrel unit 34. In addition, the barrel unit 34 and reservoir 60 may be replaced by a size enhanced auxiliary barrel unit 34*a*, FIG. 5, including a barrel reservoir 66*b* and an auxiliary reservoir 66*a* to increase the available number of simulated shots for long gun 12. The reservoir portion 66*a* also includes an alternative side fill port 67, and the laser unit 64 is attached to barrel unit 34*a* adjacent to the side fill port 67. Similar to that described above, the laser unit 64 may be removably attached via a threaded connection or may be optionally fixedly attached.

Figure 7:
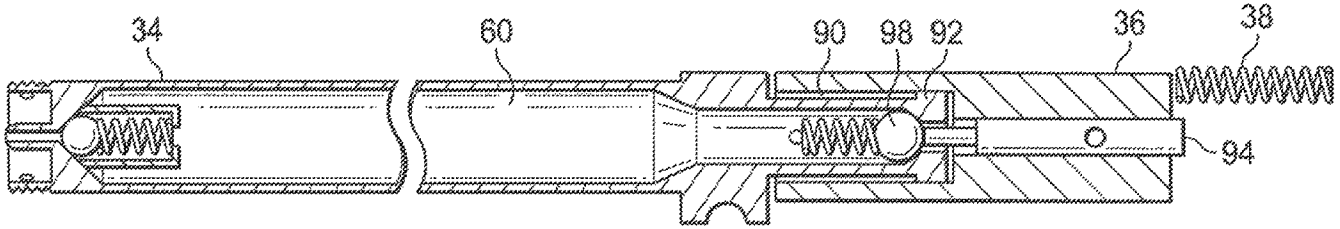

Referring to FIGS. 2 and 7, the simulated firing of long gun 12 is further discussed below. The simulated barrel unit 34 includes bolt 36 having a chamber 90 receiving a piston 92. The bolt 36 includes a striker 94 and the return spring 38 acts to urge bolt 36 to an at rest position as illustrated in FIGS. 2 and 7. Actuation of a trigger 32*a* in trigger portion 32 urges a hammer (not shown) into engagement with striker 94 which unseats a seated metering valve 98 and admits compressed gas from reservoir 60 into chamber 90 thus moving bolt 36 and striker 94 rearward to compress return spring 38. When bolt 36 passes aft of the piston 92 and venting occurs, spring 38 returns bolt 36 and striker 94 to the at rest position.

Figure 8:
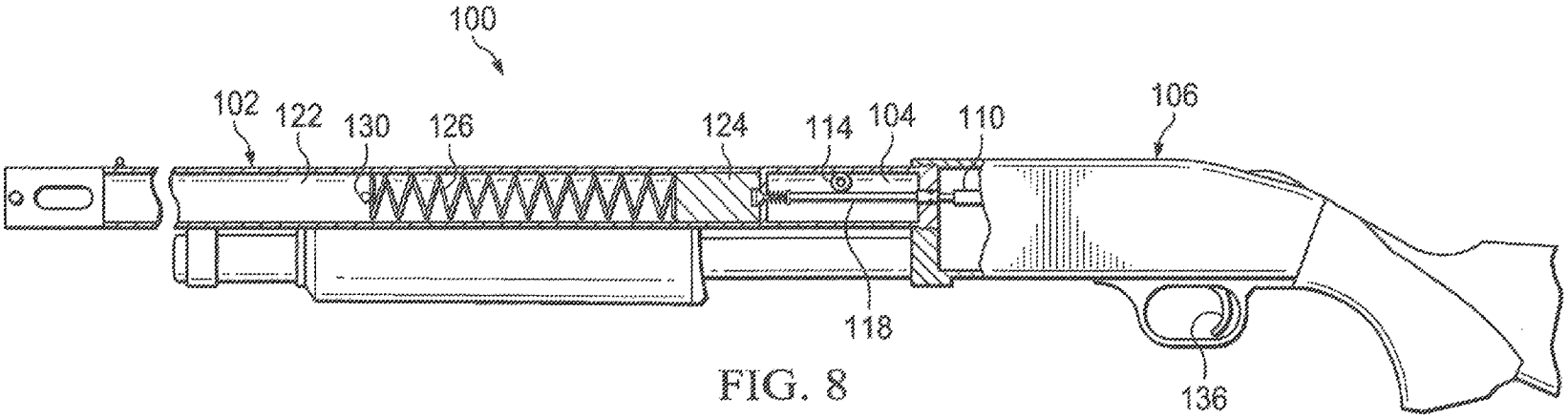
FIGS. 8 and 9 are cut-away sideviews illustrating an embodiment of a long gun having a simulated barrel unit for simulated firing.
Figure 9:
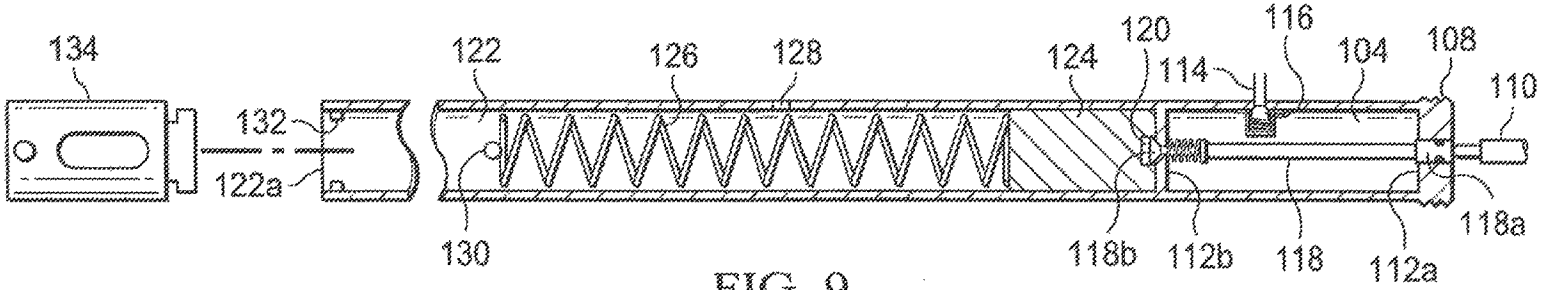

In a further embodiment, FIGS. 8 and 9 illustrate a repeating long gun 100 including a simulated barrel unit 102. The actual barrel unit (not shown) is replaced by the simulated barrel unit 102, which includes a rechargeable compressed gas reservoir 104. The simulated barrel unit 102 may be secured within a repeating shotgun/rifle type of firearm 106 by means of, for example, a threaded end 108, adjacent a firing pin 110, which is part of the firearm 106. Compressed gas reservoir 104 is positioned between a pair of spaced apart walls 112*a*, 112*b*. The reservoir 104 is sealed at the walls 112*a*, 112*b*, as discussed below and is rechargeable via a side fill port 114 including a one-way check valve which may be a ball or other type one-way check valve 116. A striker 118 has one end 118*a* sealed in wall 112*a* adjacent firing pin 110. Another end 118*b* of striker 118 is positioned adjacent wall 112*b* and includes metering check valve 120 at wall 112*b*.

A barrel chamber 122 in barrel unit 102 includes a piston 124, a spring 126, an exhaust port 128, a spring retainer 130 and means 132 for receiving a laser unit 134. The laser unit 134 may be fixedly or removably mounted in an end 122*a* of barrel unit 102.

Simulated firing is accomplished by actuation of a trigger 136 which actuates firing pin 110 into engagement with striker 118 to momentarily unseat valve 120 at wall 112*b*. Compressed air is then admitted into barrel chamber 122 and urges piston 124 to compress spring 126 until piston 124 passes exhaust port 128. Upon exhausting through the port 128, spring 126 urges piston 124 toward wall 112*b*. Rapid movement of piston 124 and its' mass simulates recoil, and venting through port 128 simulates an audible puff.

The foregoing has illustrated several embodiments of actual firearms which can be non-permanently converted to simulated firearms. An advantage to the foregoing is that the compressed air is stored, conducted within and actuates simulated firing members solely with in the simulated barrel unit, thus obviating the need to conduct the compressed gas from remote portions of the firearm to simulate firing. All check valves described herein may be of any suitable sealing type such as ball or other shaped valves, as an example.

Figure 10:
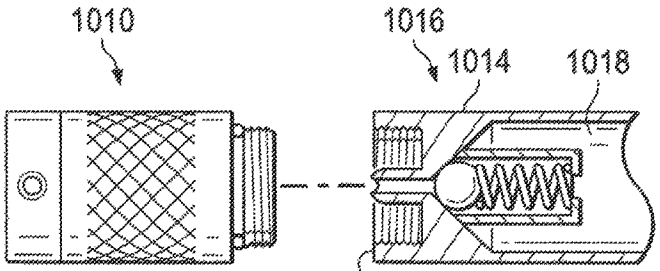
FIG. 10 is an exploded side view partially cut away illustrating an embodiment of a laser module attachable to an associated muzzle end of a barrel of a firearm simulator including a self-contained compressed gas reservoir.

In FIG. 10, a shock activated laser module 1010 is attachable to a muzzle end 1012 of a barrel 1014 of an associated firearm simulator 1016. Attachment of the module 1010 to the barrel 1014 is accomplished, as discussed above, by either a threaded attachment or a quick-connect/disconnect attachment. Barrel 1014 includes a self-contained reservoir 1018 of compressed air.

Figure 11:
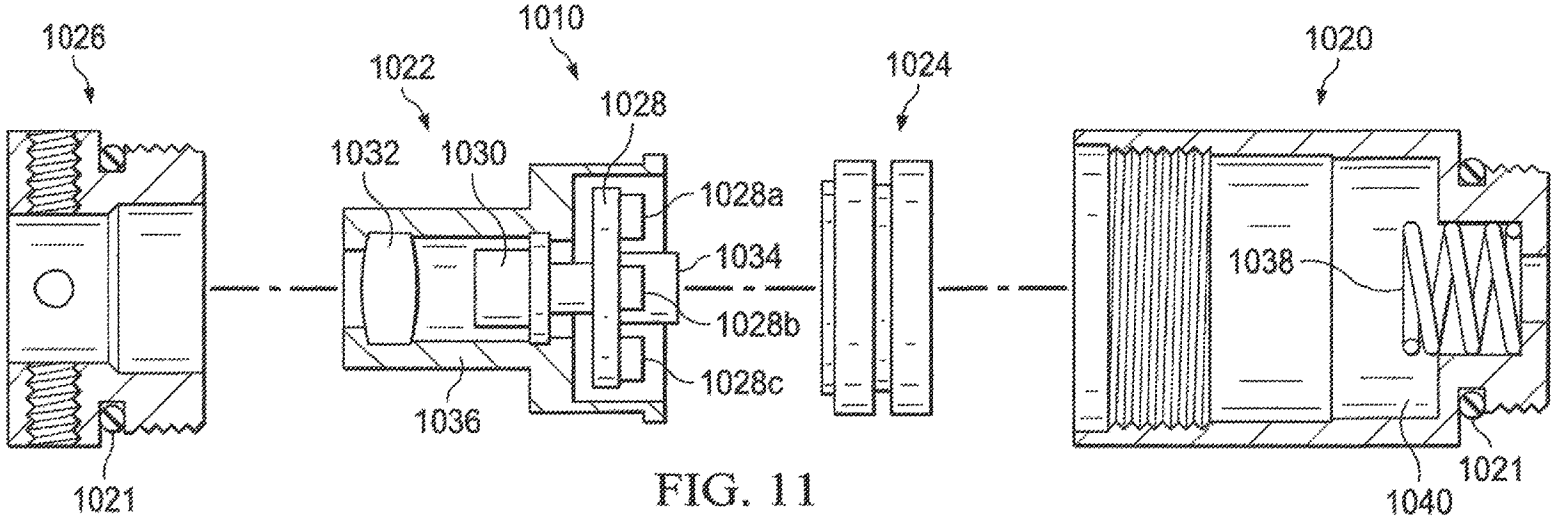
FIG. 11 is an exploded, cut-away side view illustrating an embodiment of components of the laser module of FIG. 10.

In FIG. 11, components of the laser module 1010 include a conductive housing portion 1020, an electro-optical member 1022, a stored energy member 1024 (e.g. batteries) and a retainer cap 1026. The electro-optical member 1022 contains the circuitry and the optics to generate a laser pulse. The circuitry is included at member 1028 comprising a miniature piezo-electric shock sensor 1028*a*, a microprocessor 1028*b*, a laser driver 1028*c* and a laser diode 1030. A lens 1032 is illustrated adjacent the above-described circuitry 1028. Power is supplied to the electro-optical member 1022 from batteries 1024. One pole is a contact 1034 and the other pole is conductive body 1036 of the electro-optical member 1022. Power is also supplied from the other pole of the batteries 1024 via a spring 1038 onto the conductive housing portion 1020, conductive retainer cap 1026 and onto the electro-optical member 1022. The batteries 1024 are stored in insulating sleeve 1040. The retainer cap, 1026 and the housing portion 1020 each include a compressible member 1021.

Figure 12:
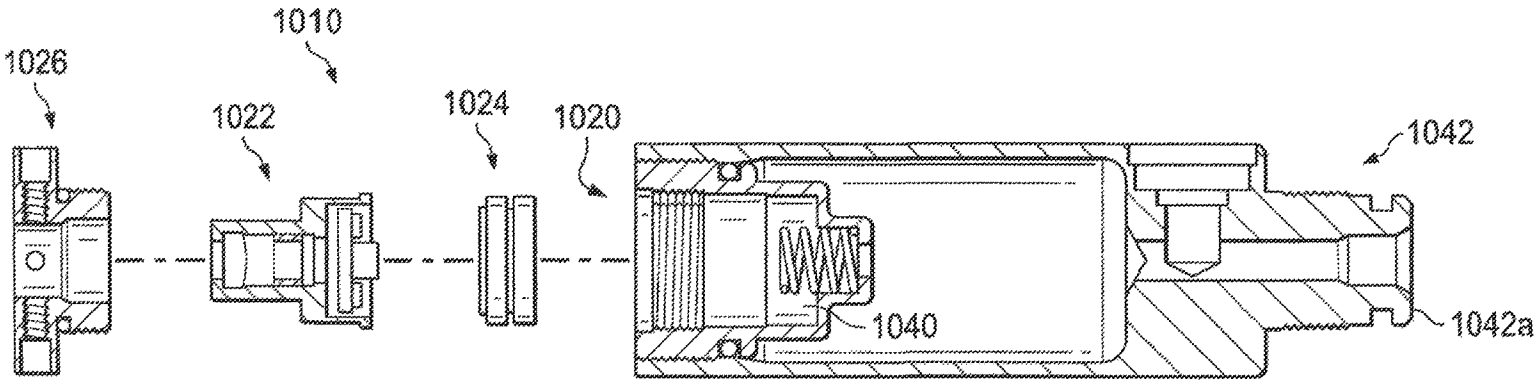
FIG. 12 is an exploded cut-away side view illustrating an embodiment of components of the laser module attachable to an auxiliary compressed gas reservoir barrel extension.

Having described the laser module 1010, FIG. 12 illustrates an application wherein the module 1010 is used in combination with a compressed gas barrel extension 1042, or auxiliary reservoir. Such a reservoir 1042 may be attached, at an end 1042*a*, to the barrel 1014 as discussed above in FIG. 10, see also FIGS. 6*e*, 6*f*. In this application the housing portion 1020 is appropriately seated within the reservoir 1042 and as such, can receive the batteries 1024, in insulating sleeve 1040, the electro-optical member 1022 and the conductive retaining cap 1026.

Figure 13:
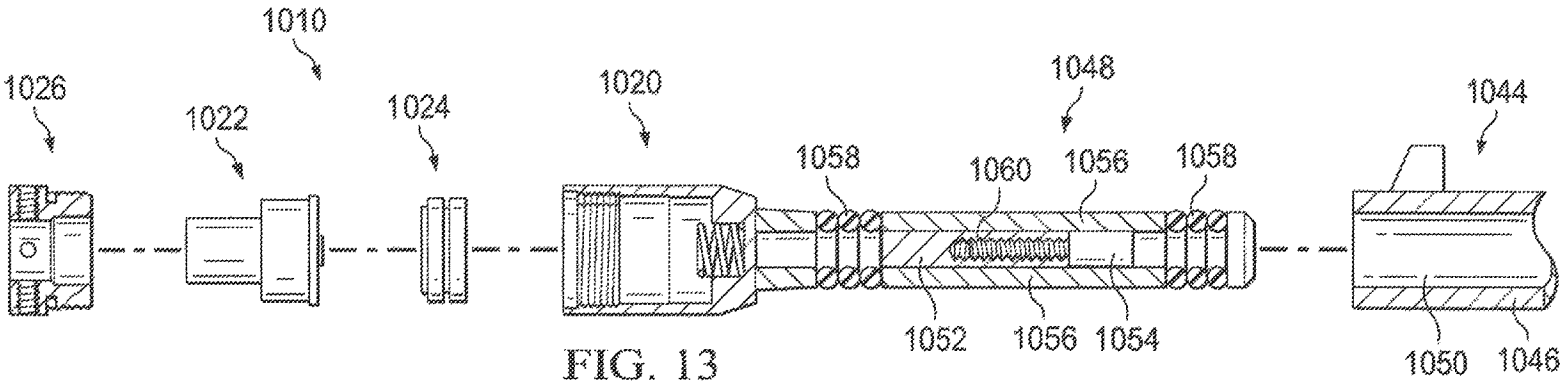
FIG. 13 is an exploded partially cut-away side view illustrating an embodiment of components of the laser module attached to a mandrel and attachable to an associated barrel of a firearm.

In another application, FIG. 13 illustrates an application wherein the module 1010 is used in combination with a firearm 1044 rather than a firearm simulator 1016, described above. In this application, a barrel portion 1046 of the firearm 1044 can receive a mandrel 1048 and the module 1010 for dry-firing practice. The mandrel 1048 may be a single member rod, not shown, including a compressible surface for providing a friction fit when mandrel 1048 is forced into a bore 1050 of barrel portion 1046. A preferred embodiment includes a fabricated mandrel 1048 constructed to be somewhat flexible for insertion but capable of a tight friction fit within the bore 1050. In this embodiment, mandrel 1048 includes rotatable mandrel members 1052, 1054, spacers 1056 and friction rings 1058 providing the compressible surface. A threaded connection 1060 permits relative movement between mandrel member 1052 and 1054. Thus, with housing portion 1020 attached to mandrel 1048, which is inserted into bore 1050, the housing portion 1020 is rotated which moves the members 1052 and 1054 axially compresses the friction rings 1058, resulting in radial expansion of the rings 1058 into a friction engagement with bore 1050. As such, batteries 1024, electro-optical member 1022 and retainer cap 1026 are engaged to complete the module 1010.

Figure 14:
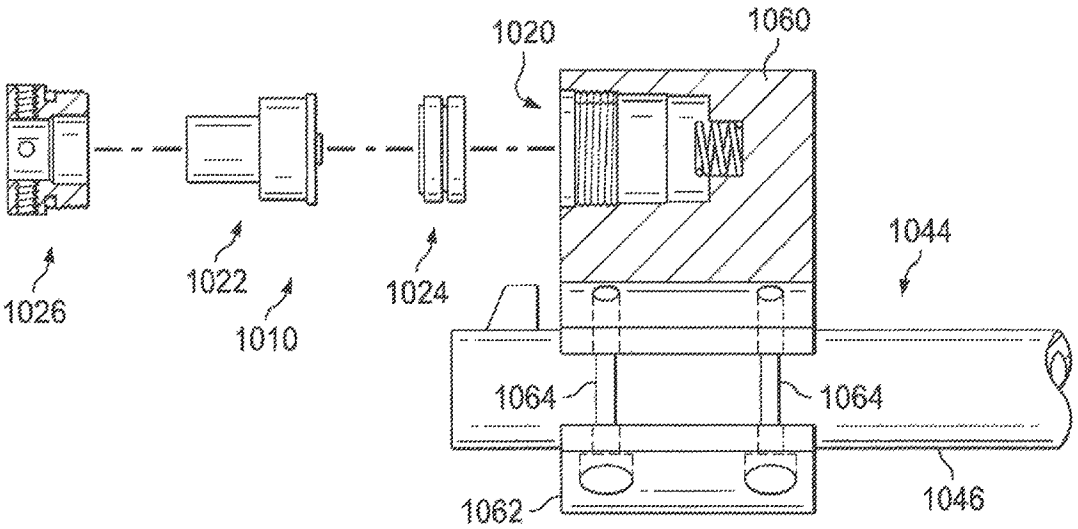
FIG. 14 is an exploded partially cut-away side view illustrating an embodiment of the laser module attached to the barrel of a firearm.

In a further application, FIG. 14 illustrates an application wherein the module 1010 is mounted externally of the barrel portion 1046 of firearm 1044 for dry-firing practice. A housing portion 1020 of module 1010 is mounted in a block 1060. The battery 1024, electro-optical member 1022 and retainer cap 1026 are engaged to complete the module 1010. Block 1060 is mounted on a surface of barrel portion 1046. A bracket 1062 is mounted on a surface of barrel portion 1046, which is opposite the block 1060. The block 1060 and bracket 1062 are secured on the barrel portion by appropriate fasteners 1064.

The firearm conversions illustrated and described herein are exemplary, however such conversions can be accomplished with modification where necessary, in any type of firearm where appropriate for converting an actual firearm, whether used for sport or as a weapon, to a firearm used for simulated shooting.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An apparatus for non-permanent conversion of a firearm into a compressed gas powered firearm simulator for simulated shooting comprising:

the firearm including a combination of actual firearm components and simulated firearm components including a simulated barrel unit:

the simulated barrel unit including a limited capacity, self-contained and sealingly stored compressed gas reservoir, a fill port recharging the compressed gas reservoir and a metering valve actuated by a firing mechanism in the firearm for releasing compressed gas from the reservoir to simulate firing of the firearm;

the barrel unit including a muzzle end supporting the fill port and a removable laser module, the laser module including a conductive laser housing portion, a stored energy member in an insulating sleeve in the housing portion, an electro-optical member in the housing portion adjacent the stored energy member, and a conductive retainer cap retaining the electro-optical member and stored energy member in the housing portion; and the electro-optical member including a laser pulse generating circuitry comprising a mini piezo-electric shock sensor, a microprocessor, a laser driver and a laser diode, the laser module further including a lens adjacent the circuitry, a pair of poles respectively engaging opposite sides of the stored energy member, and one of the poles being resiliently urged into engagement with the stored energy member.

2. The apparatus of claim 1 wherein the laser housing portion includes a female attachment end.

3. The apparatus of claim 2 wherein the female attachment end receives the stored energy member, the electro-optical member and the retainer cap.

4. The apparatus of claim 3 wherein the retainer cap includes a friction ring and a sight-adjusting member.

5. The apparatus of claim 1, further comprising:

a removable compressed gas barrel extension receiving and interconnecting the conductive laser housing with the simulated barrel unit, the barrel extension being in fluid-flow communication with the self-contained compressed gas reservoir of the simulated barrel unit, the conductive laser housing receiving and removably retaining the stored energy member, the electro-optical member and the retainer cap.

6. A method for non-permanent conversion of a firearm into a compressed gas powered firearm simulator for simulated shooting comprising:

providing the firearm with a combination of actual firearm components and simulated firearm components including a simulated barrel unit:

including a simulated barrel unit a limited capacity, self-contained and sealingly stored compressed gas reservoir, a fill port recharging the compressed gas reservoir and a metering valve actuated by a firing mechanism in the firearm for releasing compressed gas from the reservoir to simulate firing of the firearm;

providing a barrel unit with a muzzle end supporting the fill port and a removable laser module, the laser module including a first conductive laser housing portion, a stored energy member in an insulating sleeve in the housing portion, an electro-optical member in the housing portion adjacent the stored energy member, and a conductive retainer cap retaining the electro-optical member and stored energy member in the housing portion;

including in the electro-optical member a laser pulse generating circuitry comprising a mini piezo-electric shock sensor, a microprocessor, a laser driver and a laser diode, the laser module further including a lens adjacent the circuitry, a pair of poles respectively engaging opposite sides of the stored energy member, and one of the poles being resiliently urged into engagement with the stored energy member;

removing the laser module from the muzzle end of barrel unit;

attaching a first end of a compressed gas barrel extension to the muzzle end of the barrel unit in fluid communication with the self-contained compressed gas reservoir of the simulated barrel unit, a second end of the compressed gas barrel extension including the laser housing portion; and attaching the stored energy member, the electro-optical member and the conductive retainer cap to the housing portion included in the compressed gas barrel extension.

7. The method of claim 6, comprising:

providing the laser housing portion with a female attachment end.

8. The method of claim 7, comprising:

the female attachment end receiving the stored energy member, the electro-optical member and the retainer cap.

9. The method of claim 8, comprising:

the retainer cap including a friction ring and a sight adjusting member.

* * * * *